US008554114B2

(12) United States Patent
Ozawa

(10) Patent No.: US 8,554,114 B2
(45) Date of Patent: Oct. 8, 2013

(54) ROTATING-BODY RESTRAINING DEVICE AND IMAGE FORMING METHOD

(75) Inventor: Hideaki Ozawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 203 days.

(21) Appl. No.: 13/117,490

(22) Filed: May 27, 2011

(65) Prior Publication Data

US 2012/0114383 A1 May 10, 2012

(30) Foreign Application Priority Data

Nov. 9, 2010 (JP) ..... 2010-250734

(51) Int. Cl.
*G03G 15/01* (2006.01)
*F16H 1/06* (2006.01)

(52) U.S. Cl.
USPC ..... 399/227; 74/411.5

(58) Field of Classification Search
USPC ..... 399/227
See application file for complete search history.

(56) References Cited

U.S. PATENT DOCUMENTS 7,386,261 B2 * 6/2008 Noguchi et al. ..... 399/258
7,933,538 B2 * 4/2011 Aoki et al. ..... 399/227
8,224,228 B2 * 7/2012 Saitou et al. ..... 399/380

FOREIGN PATENT DOCUMENTS

JP 2005-062659 A 3/2005

* cited by examiner

*Primary Examiner* — Clayton E Laballe
*Assistant Examiner* — Michael Harrison
(74) *Attorney, Agent, or Firm* — Sughrue Mion, PLLC

(57) ABSTRACT

A rotating-body restraining device includes a first gear provided on a rotational shaft of a rotating body and rotated together with the rotating body, a second gear that meshes with the first gear, a third gear provided on a rotational shaft of the second gear and rotated together with the second gear, and a restraining member that is movable toward the third gear and that restrains the third gear from rotating by moving to a position where the restraining member meshes with the third gear. The numbers of teeth included in the first, second, and third gears are Za, Zb, and Zc, respectively. Zb is not equal to the product of Za and an integer n. Zc is an integral multiple of a value obtained by dividing the least common multiple of Za and Zb by Za.

11 Claims, 5 Drawing Sheets

ROTATING-BODY RESTRAINING DEVICE AND IMAGE FORMING METHOD

CROSS-REFERENCE TO RELATED APPLICATIONS

This application is based on and claims priority under 35 USC 119 from Japanese Patent Application No. 2010-250734 filed Nov. 9, 2010.

BACKGROUND

The present invention relates to a rotating-body restraining device and an image forming apparatus including the rotating-body restraining device.

SUMMARY

According to an aspect of the invention, there is provided a rotating-body restraining device including a first gear provided on a rotational shaft of a rotating body and rotated together with the rotating body, the number of teeth included in the first gear being Za; a second gear that meshes with the first gear, the number of teeth included in the second gear being Zb, which is not equal to the product of Za and an integer n; a third gear provided on a rotational shaft of the second gear and rotated together with the second gear, the number of teeth included in the third gear being Zc, which is an integral multiple of a value obtained by dividing the least common multiple of Za and Zb by Za; and a restraining member that is movable toward the third gear and that restrains the third gear from rotating by moving to a position where the restraining member meshes with the third gear.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described in detail with reference to the drawings.

Basic Structure of Image Forming Apparatus

Figure 1:
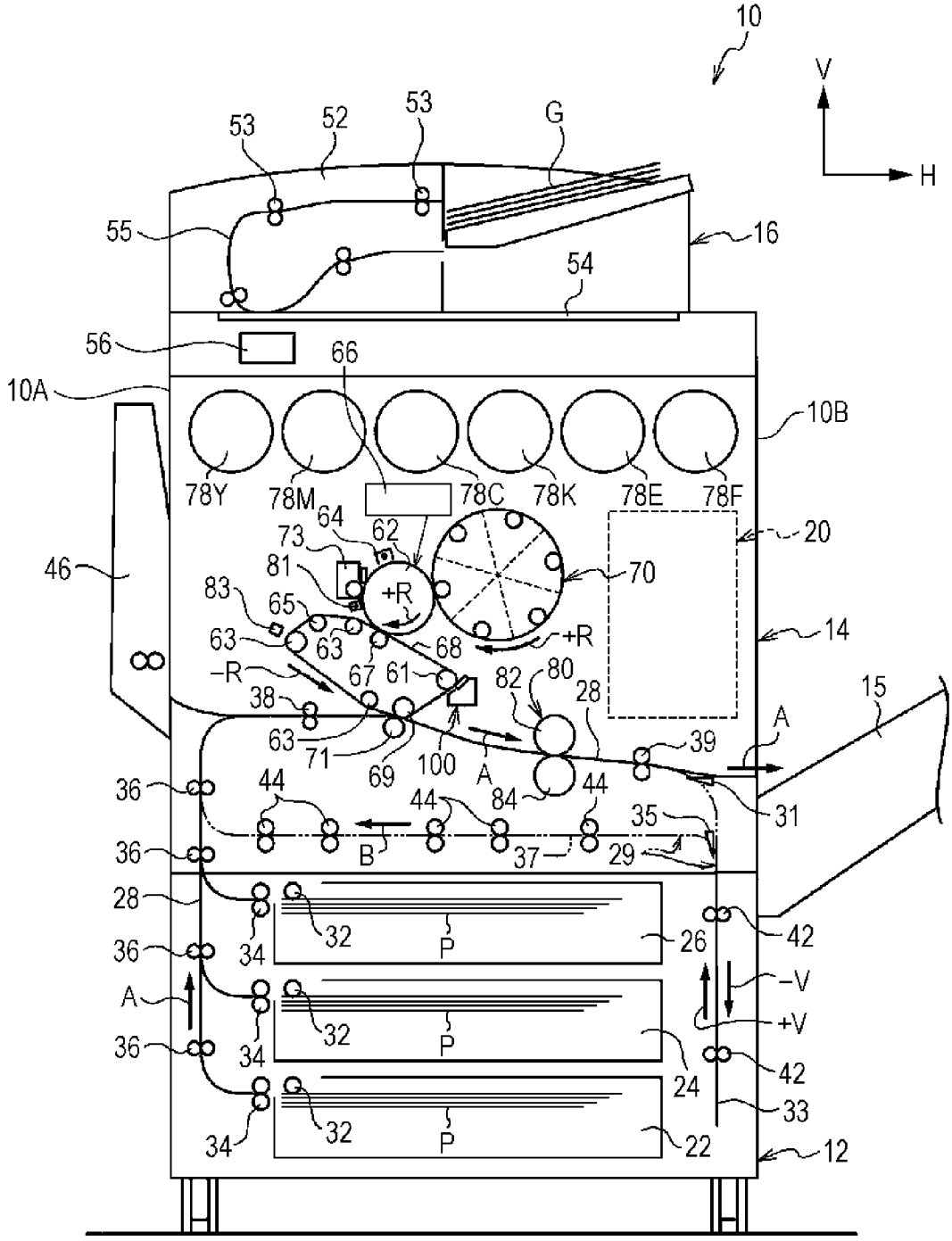
FIG. 1 illustrates the structure of an image forming apparatus according to an exemplary embodiment.

First, the structure of an image forming apparatus according to the present exemplary embodiment will be described. FIG. 1 is a schematic diagram illustrating the structure of an image forming apparatus 10 according to the present exemplary embodiment.

The image forming apparatus 10 includes a sheet storing unit 12 in which the recording paper P is stored; an image forming unit 14 which is located above the sheet storing unit 12 and forms images on sheets of recording paper P fed from the sheet storing unit 12; and an original-document reading unit 16 which is located above the image forming unit 14 and reads an original document G. The image forming apparatus 10 also includes a controller 20 that is provided in the image forming unit 14 and controls the operation of each part of the image forming apparatus 10. In the following description, the vertical direction and the horizontal direction with respect to an apparatus body 10A of the image forming apparatus 10 will be referred to as the direction of arrow V and the direction of arrow H, respectively.

The sheet storing unit 12 includes a first storage unit 22, a second storage unit 24, and a third storage unit 26 in which sheets of recording paper P having different sizes are stored. Each of the first storage unit 22, the second storage unit 24, and the third storage unit 26 are provided with a feeding roller 32 that feeds the stored sheets of recording paper P to a transport path 28 in the image forming apparatus 10. Pairs of transport rollers 34 and 36 that transport the sheets of recording paper P one at a time are provided along the transport path 28 in an area on the downstream of each feeding roller 32. A pair of positioning rollers 38 are provided on the transport path 28 at a position downstream of the transport rollers 36 in a transporting direction of the sheets of recording paper P. The positioning rollers 38 temporarily stop each sheet of recording paper P and feed the sheet toward a second transfer position, which will be described below, at a predetermined timing.

In the front view of the image forming apparatus 10, an upstream part of the transport path 28 extends in the direction of arrow V from the left side of the sheet storing unit 12 to the lower left part of the image forming unit 14. A downstream part of the transport path 28 extends from the lower left part of the image forming unit 14 to a paper output unit 15 provided on the right side of the image forming unit 14. A duplex-printing transport path 29, which is provided for reversing and transporting each sheet of recording paper P in a duplex printing process, is connected to the transport path 28.

In the front view of the image forming apparatus 10, the duplex-printing transport path 29 includes a first switching member 31, a reversing unit 33, a transporting unit 37, and a second switching member 35. The first switching member 31 switches between the transport path 28 and the duplex-printing transport path 29. The reversing unit 33 extends linearly in the direction of arrow V from a lower right part of the image forming unit 14 along the right side of the sheet storing unit 12. The transporting unit 37 receives the trailing end of each sheet of recording paper P that has been transported to the reversing unit 33 and transports the sheet in the direction of arrow H. The second switching member 35 switches between the reversing unit 33 and the transporting unit 37. The reversing unit 33 includes plural pairs of transport rollers 42 that are arranged with intervals therebetween, and the transporting unit 37 includes plural pairs of transport rollers 44 that are arranged with intervals therebetween.

The first switching member 31 has the shape of a triangular prism, and a point end of the first switching member 31 is moved by a driving unit (not shown) to one of the transport path 28 and the duplex-printing transport path 29. Thus, the transporting direction of each sheet of recording paper P is changed. Similarly, the second switching member 35 has the shape of a triangular prism, and a point end of the second switching member 35 is moved by a driving unit (not shown) to one of the reversing unit 33 and the transporting unit 37. Thus, the transporting direction of each sheet of recording paper P is changed. The downstream end of the transporting unit 37 is connected to the transport path 28 by a guiding member (not shown) at a position in front of the transport rollers 36 in the upstream part of the transport path 28. A foldable manual sheet-feeding unit 46 is provided on the left side of the image forming unit 14. The sheets of recording paper P may be fed to the positioning rollers 38 on the transport path 28 from the manual sheet-feeding unit 46.

The original-document reading unit 16 includes a document transport device 52 that transports the sheets of the original document G one at a time; a platen glass 54 which is located below the document transport device 52 and on which the sheets of the original document G are placed one at a time; and an original-document reading device 56 that scans each sheet of the original document G while the sheet is being transported by the document transport device 52 or placed on the platen glass 54. The document transport device 52 includes a transport path 55 along which pairs of transport rollers 53 are arranged. A part of the transport path 55 is arranged such that each sheet of the original document G moves along the top surface of the platen glass 54. The original-document reading device 56 scans each sheet of the original document G that is being transported by the document transport device 52 while being stationary at the left edge of the platen glass 54. Alternatively, the original-document reading device 56 scans each sheet of the original document G placed on the platen glass 54 while moving in the direction of arrow H.

The image forming unit 14 includes a cylindrical photoconductor 62 arranged in a substantially central area of the apparatus body 10A. The photoconductor 62 is rotated in the direction shown by arrow +R (clockwise in FIG. 1) by a driving unit (not shown), and carries an electrostatic latent image formed by irradiation with light. In addition, a corotron charging device 64 that charges the outer peripheral surface of the photoconductor 62 is provided above the photoconductor 62 so as to face the outer peripheral surface of the photoconductor 62.

An exposure device 66 is provided so as to face the outer peripheral surface of the photoconductor 62 at a position downstream of the charging device 64 in the rotational direction of the photoconductor 62. The outer peripheral surface of the photoconductor 62 that has been charged by the charging device 64 is irradiated with light (exposed to light) by the exposure device 66 on the basis of an image signal corresponding to each color of toner. Thus, an electrostatic latent image is formed.

A rotation-switching developing device 70 is provided downstream of a position where the photoconductor 62 is irradiated with exposure light by the exposure device 66 in the rotational direction of the photoconductor 62. The developing device 70 visualizes the electrostatic latent image on the outer peripheral surface of the photoconductor 62 by developing the electrostatic latent image with toner of each color. The developing device 70 will be described in detail below.

An intermediate transfer belt 68 is provided downstream of the developing device 70 in the rotational direction of the photoconductor 62 and below the photoconductor 62. A toner image formed on the outer peripheral surface of the photoconductor 62 is transferred onto the intermediate transfer belt 68. The intermediate transfer belt 68 is an endless belt, and is wound around a driving roller 61 that is rotated by the controller 20, a tension-applying roller 63 that applies a tension to the intermediate transfer belt 68, plural transport rollers 65 that are in contact with the back surface of the intermediate transfer belt 68 and are rotationally driven, and an auxiliary roller 69 that is in contact with the back surface of the intermediate transfer belt 68 at the second transfer position, which will be described below, and is rotationally driven. The intermediate transfer belt 68 is rotated in the direction shown by arrow −R (counterclockwise in FIG. 2) when the driving roller 61 is rotated.

A first transfer roller 67 is opposed to the photoconductor 62 with the intermediate transfer belt 68 interposed therebetween. The first transfer roller 67 performs a first transfer process in which the toner image formed on the outer peripheral surface of the photoconductor 62 is transferred onto the intermediate transfer belt 68. The first transfer roller 67 is in contact with the back surface of the intermediate transfer belt 68 at a position downstream of the position where the photoconductor 62 is in contact with the intermediate transfer belt 68 in the moving direction of the intermediate transfer belt 68. The first transfer roller 67 receives electricity from a power source (not shown), so that a potential difference is generated between the first transfer roller 67 and the photoconductor 62, which is grounded. Thus, the first transfer process is carried out in which the toner image on the photoconductor 62 is transferred onto the intermediate transfer belt 68.

A second transfer roller 71 is opposed to the auxiliary roller 69 with the intermediate transfer belt 68 interposed therebetween. The second transfer roller 71 performs a second transfer process in which toner images that have been transferred onto the intermediate transfer belt 68 in the first transfer process are transferred onto the sheet of recording paper P. The position between the second transfer roller 71 and the auxiliary roller 69 serves as the second transfer position at which the toner images are transferred onto the sheet of recording paper P. The second transfer roller 71 is in contact with the intermediate transfer belt 68. The second transfer roller 71 receives electricity from a power source (not shown), so that a potential dereference is generated between the second transfer roller 71 and the auxiliary roller 69, which is grounded. Thus, the second transfer process is carried out in which the toner images on the intermediate transfer belt 68 are transferred onto the sheet of recording paper P.

A cleaning device 100, which is an example of a developer collecting device, is opposed to the driving roller 61 with the intermediate transfer belt 68 interposed therebetween. The cleaning device 100 collects residual toner that remains on the intermediate transfer belt 68 after the second transfer process. The cleaning device 100 includes a cleaning blade 106 that comes into contact with the intermediate transfer belt 68 to remove the toner from the intermediate transfer belt 68. The cleaning blade 106 of the cleaning device 100 and the second transfer roller 71 are separated from the outer peripheral surface of the intermediate transfer belt 68 until the toner images of the respective colors are transferred onto the intermediate transfer belt 68 in a superimposed manner (first transfer process) and then transferred onto the sheet of recording paper P (second transfer process).

A position detection sensor 83 is opposed to the tension-applying roller 63 at a position outside the intermediate transfer belt 68. The position detection sensor 83 detects a predetermined reference position on the surface of the intermediate transfer belt 68 by detecting a mark (not shown) on the intermediate transfer belt 68. The position detection sensor 83 outputs a position detection signal that serves as a reference for the time to start an image forming process.

A cleaning device 73 is provided downstream of the first transfer roller 67 in the rotational direction of the photoconductor 62. The cleaning device 73 removes residual toner and the like that remain on the surface of the photoconductor 62 instead of being transferred onto the intermediate transfer belt 68 in the first transfer process. The cleaning device 73 collects the residual toner and the like with a cleaning blade 73A and a brush roller 73B that are in contact with the surface of the photoconductor 62. The collected residual toner and the like are discharged from the cleaning device 73 by a toner discharging device 73C that has an auger therein. An erase device 81 is provided upstream of the cleaning device 73 and downstream of the first transfer roller 67 in the rotational direction of the photoconductor 62. The erase device 81 removes the electric charge by irradiating the outer peripheral surface of the photoconductor 62 with light. The erase device 81 removes the electric charge by irradiating the outer peripheral surface of the photoconductor 62 with light before the residual toner and the like are collected by the cleaning device 73. Accordingly, the electrostatic adhesion force is reduced and the collection rate of the residual toner and the like is increased. An additional erase device for removing the electric charge after the collection of the residual toner and the like may be provided downstream of the cleaning device 73 and upstream of the charging device 64.

As illustrated in FIG. 1, the second transfer position at which the toner images are transferred onto the sheet of recording paper P by the second transfer roller 71 is at an intermediate position of the above-described transport path 28. A fixing device 80 is provided on the transport path 28 at a position downstream of the second transfer roller 71 in the transporting direction of the sheet of recording paper P (direction shown by arrow A). The fixing device 80 fixes the toner images that have been transferred onto the sheet of recording paper P by the second transfer roller 71. The fixing device 80 includes a heating roller 82 and a pressing roller 84. The heating roller 82 is disposed at the side of the sheet of recording paper P at which the toner images are formed (upper side), and includes a heat source which generates heat when electricity is supplied thereto. The pressing roller 84 is positioned below the heating roller 82, and presses the sheet of recording paper P against the outer peripheral surface of the heating roller 82. Transport rollers 39 that transport the sheet of recording paper P to the paper output unit 15 or the reversing unit 33 are provided on the transport path 28 at a position downstream of the fixing device 80 in the transporting direction of the sheet of recording paper P.

Toner cartridges 78Y, 78M, 78C, 78K, 78E, and 78F that respectively contain yellow (Y) toner, magenta (M) toner, cyan (C) toner, black (K) toner, toner of a first specific color (E), and toner of a second specific color (F) are arranged in the horizontal direction in a replaceable manner in an area below the original-document reading device 56 and above the developing device 70.

The first and second specific colors E and F may be selected from specific colors (including transparent) other than yellow, magenta, cyan, and black. Alternatively, the first and second specific colors E and F are not selected. When the first and second specific colors E and F are selected, the developing device 70 performs the image forming process using six colors, which are Y, M, C, K, E, and F. When the first and second specific colors E and F are not selected, the developing device 70 performs the image forming process using four colors, which are Y, M, C, and K.

The image forming apparatus 10 includes an opening-closing unit 10B that is capable of being opened or closed with respect to the apparatus body 10A. The opening-closing unit 10B is provided on the right side of the image forming unit 14.

Structure of Developing Device

The detailed structure of the developing device 70 will now be described.

Figure 2:
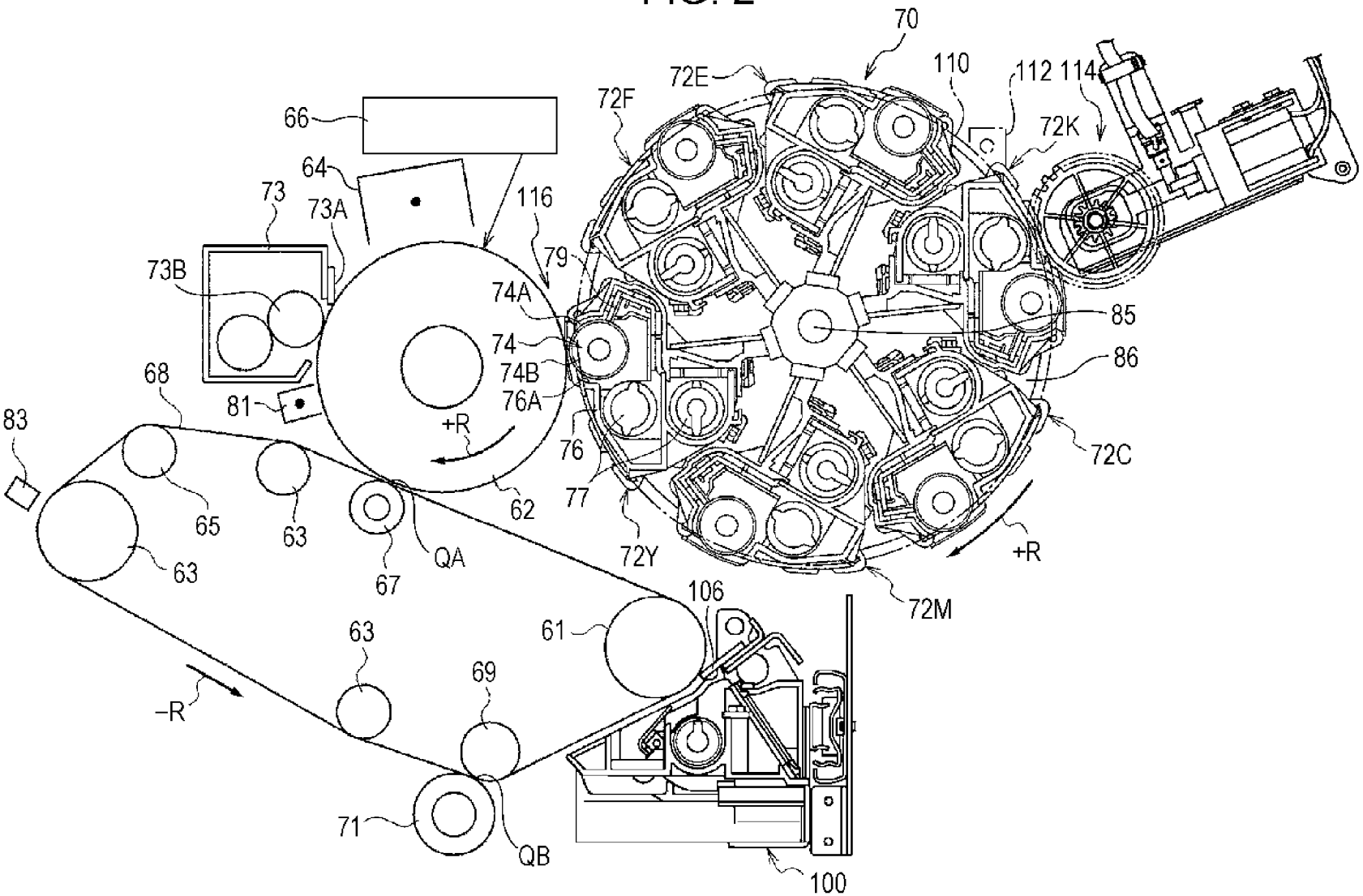
FIG. 2 illustrates the structure around a photoconductor according to the exemplary embodiment.

As illustrated in FIG. 2, the developing device 70 includes a rotating body 86 that is supported such that the rotating body 86 is rotatable around a rotational shaft 85 with respect to the apparatus body 10A (see FIG. 1). A rotating-body gear 110, which is an example of a first gear, is provided on the rotational shaft 85. The rotating-body gear 110 rotates together with the rotating body 86. The rotating-body gear 110 is connected to an output shaft of an electric motor 112, which is an example of a driving unit. The rotational output of the electric motor 112 is transmitted to the rotating body 86 through the rotating-body gear 110, and the rotating body 86 is rotated accordingly. The rotating-body gear 110 is connected to a lock mechanism 114, which is an example of a rotating-body restraining device that stops (restrains) the rotation of the rotating body 86. The lock mechanism 114 will be described in detail below.

Developing units 72Y, 72M, 72C, 72K, 72E, and 72F corresponding to the respective colors, which are yellow (Y), magenta (M), cyan (C), black (K), the first specific color (E), and the second specific color (F), respectively, are arranged on the rotating body 86 in that order in along the circumferential direction (counterclockwise in FIG. 2).

The rotating body 86 is rotated by the electric motor 112 in steps of 60° in the direction shown by arrow +R. Accordingly, one of the developing units 72Y, 72M, 72C, 72K, 72E, and 72F that is to perform a developing process is selectively opposed to the outer peripheral surface of the photoconductor 62 at a developing position 116. The developing units 72Y, 72M, 72C, 72K, 72E, and 72F have similar structures. Therefore, only the developing unit 72Y will be described, and explanations of the other developing units 72M, 72C, 72K, 72E, and 72F will be omitted.

The developing unit 72Y includes a casing member 76, which serves as a base body. The casing member 76 is filled with developer (not shown) including toner and carrier. The developer is supplied from the toner cartridge 78Y (see FIG. 1) through a toner supply channel (not shown). The casing member 76 has a rectangular opening 76A that is opposed to the outer peripheral surface of the photoconductor 62. A developing roller 74 is disposed in the opening 76A so as to face the outer peripheral surface of the photoconductor 62. The developing roller 74 is rotatably supported by the casing member 76. A plate-shaped regulating member 79, which regulates the thickness of a developer layer that is transported by the developing roller 74, is provided along the longitudinal direction of the opening 76A at a position near the opening 76A in the casing member 76.

The developing roller 74 includes a rotatable cylindrical developing sleeve 74A and a magnetic unit 74B fixed to the inner surface of the developing sleeve 74A and including plural magnetic poles. In the developing roller 74, a magnetic brush made of the developer (carrier) is formed as the developing sleeve 74A is rotated, and the thickness of the magnetic brush is regulated by the regulating member 79. Thus, the developer layer is formed on the outer peripheral surface of the developing sleeve 74A. The developer layer on the outer peripheral surface of the developing sleeve 74A is moved to the position where the developing sleeve 74A faces the photoconductor 62. Accordingly, the toner adheres to the latent image (electrostatic latent image) formed on the outer peripheral surface of the photoconductor 62. Thus, the latent image is developed.

Two helical transport rollers 77 are rotatably arranged in parallel to each other in the casing member 76. The two transport rollers 77 rotate so as to circulate the developer contained in the casing member 76 in the axial direction of the developing roller 74 (longitudinal direction of the developing unit 72Y). Six developing rollers 74 are included in the respective developing units 72Y, 72M, 72C, 72K, 72E, and 72F, and are arranged along the circumferential direction so as to be separated form each other by 60° in terms of the central angle. When the developing units 72 are switched, the developing roller 74 in the newly selected developing unit 72 is caused to face the outer peripheral surface of the photoconductor 62.

An image forming process performed by the image forming apparatus 10 will be described.

Referring to FIG. 1, when the image forming apparatus 10 is activated, image data of respective colors, which are yellow (Y), magenta (M), cyan (C), black (K), the first specific color (E), and the second specific color (F), are successively output to the exposure device 66 from an image processing device (not shown) or an external device. At this time, the developing device 70 is held such that the developing unit 72Y, for example, is opposed to the outer peripheral surface of the photoconductor 62 (see FIG. 2).

The exposure device 66 emits light in accordance with the image data, and the outer peripheral surface of the photoconductor 62, which has been charged by the charging device 64, is exposed to the emitted light. Accordingly, an electrostatic latent image corresponding to the yellow image data is formed on the surface of the photoconductor 62. The electrostatic latent image formed on the surface of the photoconductor 62 is developed as a yellow toner image by the developing unit 72Y. The yellow toner image on the surface of the photoconductor 62 is transferred onto the intermediate transfer belt 68 by the first transfer roller 67.

Then, referring to FIG. 1, the developing device 70 is rotated by 60° in the direction shown by arrow +R, so that the developing unit 72M is opposed to the surface of the photoconductor 62. Then, the charging process, the exposure process, and the developing process are performed so that a magenta toner image is formed on the surface of the photoconductor 62. The magenta toner image is transferred onto the yellow toner image on the intermediate transfer belt 68 by the first transfer roller 67. Similarly, cyan (C) and black (K) toner images and toner images of the first specific color (E) and the second specific color (F) are successively transferred onto the intermediate transfer belt 68.

A sheet of recording paper P is fed from the sheet storing section 12 and transported along the transport path 28. Then, the sheet is transported by the positioning rollers 38 to the second transfer position in synchronization with the time at which the toner images are transferred onto the intermediate transfer belt 68 in a superimposed manner. Then, the second transfer process is performed in which the toner images that have been transferred onto the intermediate transfer belt 68 in a superimposed manner are transferred by the second transfer roller 71 onto the sheet of recording paper P that has been transported to the second transfer position.

The sheet of recording paper P onto which the toner images have been transferred is transported toward the fixing device 80 in the direction shown by arrow A (rightward in FIG. 1). The fixing device 80 fixes the toner images on the sheet of recording paper P by applying heat and pressure thereto with the heating roller 82 and the pressing roller 84. The sheet of recording paper P on which the toner images are fixed are ejected to, for example, the paper output unit 15. When images are to be formed on both sides of the sheet of recording paper P, the following process is performed. That is, after the toner images on the front surface of the sheet of recording paper P are fixed by the fixing device 80, the sheet is transported to the reversing unit 33 and reversed. Then, the sheet is transported to the second transfer position. Then, the back surface of the sheet of recording paper P is subjected to the image forming process and the fixing process.

Lock Mechanism

Next, the lock mechanism 114 according to the present exemplary embodiment will be described.

Figure 3:
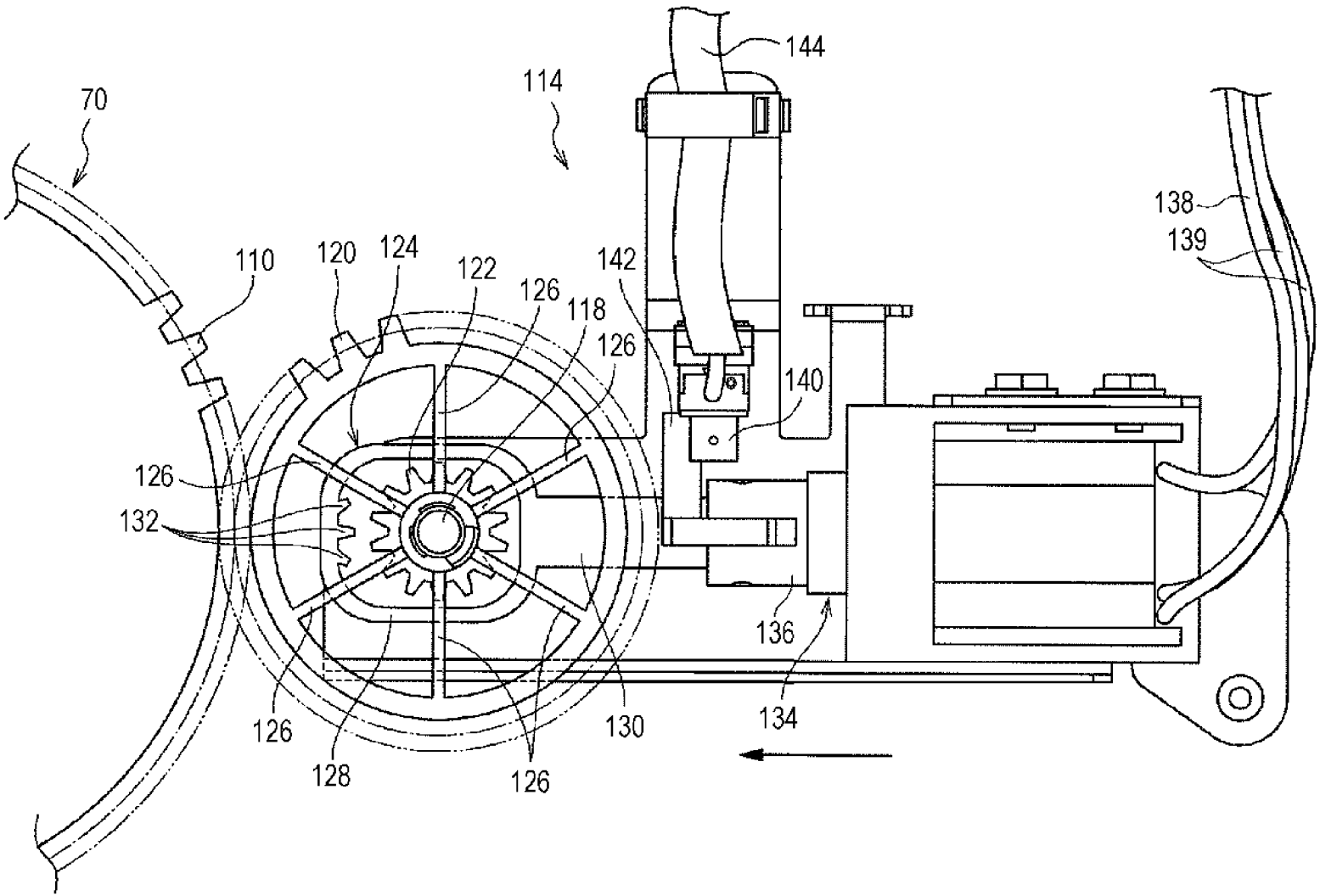
FIG. 3 is a side view illustrating the manner in which a lock device according to the exemplary embodiment is operated.

As illustrated in FIG. 3, the lock mechanism 114 includes a large gear 120 as an example of a second gear, a small gear 122 as an example of a third gear, and a lock lever 124 as an example of a securing member. The large gear 120 meshes with the rotating-body gear 110 and is rotated by rotation of the rotating-body gear 110 around a rotational shaft 118. The small gear 122 is disposed inside the large gear 120. The lock lever 124 meshes with the small gear 122 and restrains rotation of the small gear 122.

The large gear 120 is connected to the rotational shaft 118 with six ribs 126. The small gear 122 is fixed to the rotational shaft 118, and rotates together with the large gear 120. The lock lever 124 includes a ring-shaped portion 128 that is ring shaped and arranged at the periphery of the small gear 122 so as to surround the small gear 122 and a shaft portion 130 that is connected to the outer peripheral surface of the ring-shaped portion 128 at one end thereof. Three projections (internal teeth) 132 that are shaped to be capable of meshing with the small gear 122 are formed on the inner surface of the ring-shaped portion 128.

The shaft portion 130 is connected to a movable shaft 136 of an electromagnetic solenoid 134. A signal line 138 and a power line 139, which extend from the controller 20 (see FIG. 1), are connected to the electromagnetic solenoid 134. A proximity sensor 140 is disposed near the movable shaft 136 of the electromagnetic solenoid 134, and a detection member 142 to be detected by the proximity sensor 140 is attached to the movable shaft 136 of the electromagnetic solenoid 134. A signal line 144 that extends from the controller 20 is connected to the proximity sensor 140.

When the electromagnetic solenoid 134 is not excited, the movable shaft 136 is extracted from the base body, as illustrated in FIG. 3, so that the lock lever 124 is disposed at a position where the lock lever 124 does not mesh with the small gear 122. In this state, rotation of the small gear 122 is not restrained by the lock lever 124. Accordingly, the developing device 70, the rotating-body gear 110, and the large gear 120 are all in a rotatable state.

Figure 4:
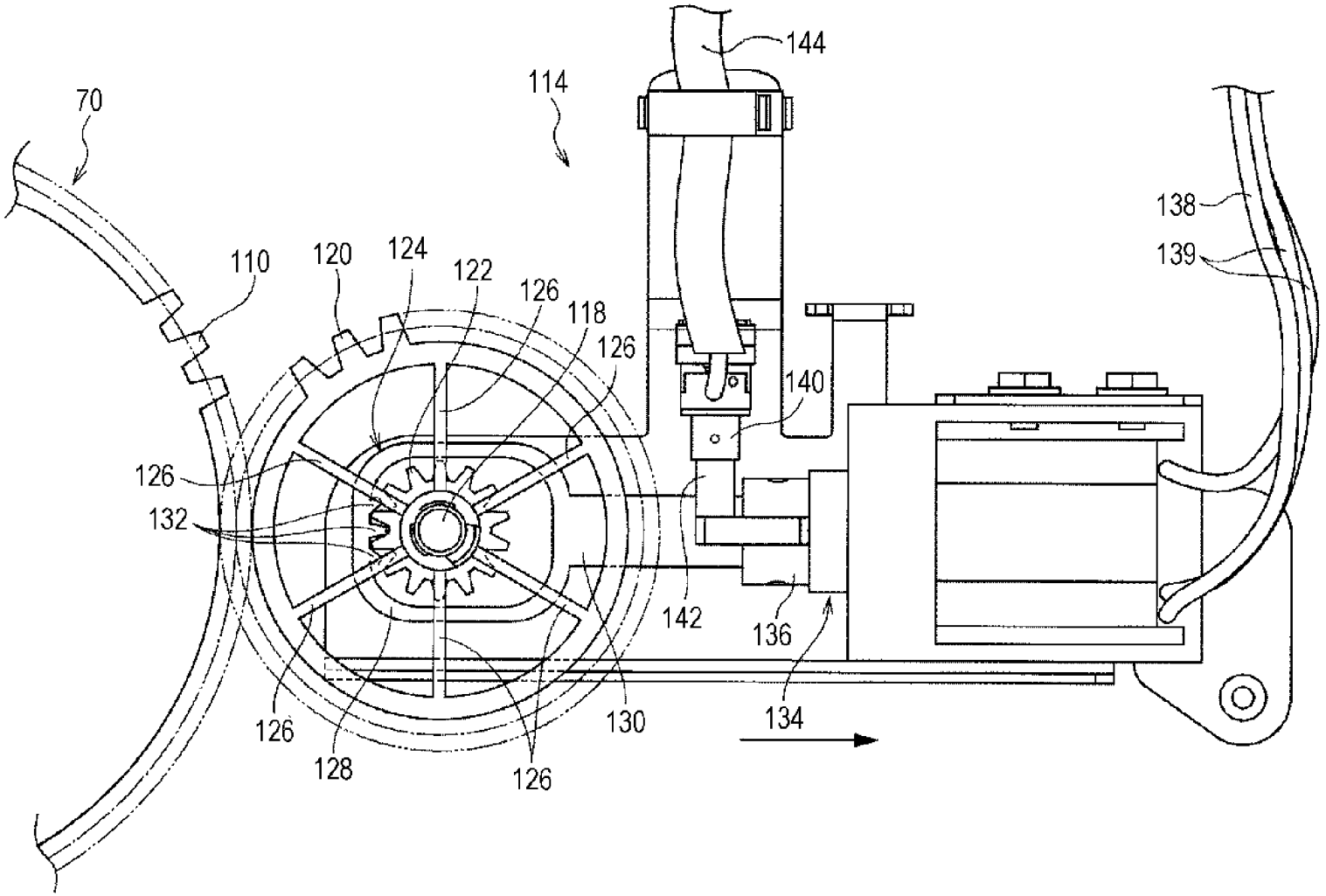
FIG. 4 is a side view similar to FIG. 3, illustrating the manner in which the lock device according to the exemplary embodiment is operated.

When the electromagnetic solenoid 134 is excited, the movable shaft 136 is pulled into the base body, as illustrated in FIG. 4, so that the lock lever 124 is moved to a position where the lock lever 124 meshes with the small gear 122. Accordingly, the small gear 122 is restrained from rotating by the lock lever 124. As a result, the developing device 70, the rotating-body gear 110, and the large gear 120 are also restrained from rotating.

When the electromagnetic solenoid 134 is not excited, the detection member 142 is positioned away from the detection position of the proximity sensor 140, as illustrated in FIG. 3. When the electromagnetic solenoid 134 is excited, the detection member 142 is moved to the detection position of the proximity sensor 140, as illustrated in FIG. 4. The proximity sensor 140 transmits a signal representing the position of the movable shaft 136, that is, a signal representing whether or not the lock lever 124 is meshed with the small gear 122 to secure the developing device 70, to the controller 20 (see FIG. 1).

When a multicolor developing process (color printing) is performed by the developing device 70 using toners of at least two colors selected from yellow (Y), magenta (M), cyan (C), black (K), the first specific color (E), and the second specific color (F), it is necessary to rotate the developing device 70. Accordingly, the electromagnetic solenoid 134 is not excited so that the developing device 70 is not secured by the lock mechanism 114. In the multicolor developing process, the developing device 70 is set to a hold state by exciting the electric motor 112 while each of the developing units of respective colors in the developing device 70 is at the developing position 116.

When a single-color developing process (monochrome printing) is performed by the developing device 70 using only the black (K) toner, it is not necessary to rotate the developing device 70. Therefore, the electromagnetic solenoid 134 is excited while the black (K) developing unit 72K is at the developing position 116 (see FIG. 2), so that the developing device 70 is secured by the lock mechanism 114. In the single-color developing process, excitation of the electric motor 112 is stopped to reduce energy consumption.

To accurately secure the developing device 70 at a rotational angle position (hereinafter referred to as a "desired rotational angle position") at which the black (K) developing unit 72K is at the developing position 116, the number of teeth of the small gear 122 is set as described below in the gear mechanism including the rotating-body gear 110, the large gear 120, and the small gear 122.

Here, the numbers of teeth of the rotating-body gear 110, the large gear 120, and the small gear 122 are defined as Za, Zb, and Zc, respectively. When the rotating-body gear 110 rotates one turn, the small gear 122 rotates Za/Zb turn. The number of teeth Zc of the small gear 122 is set such that a value obtained by dividing the number of turns Za/Zb by the pitch angle (1/Zc) of the small gear 122, that is, the value of (Za/Zb)×Zc, is an integer. In such a case, when the developing device 70 is at the desired rotational angle position, the small gear 122 is always at the position where the small gear 122 is engageable with the three projections 132 of the lock lever 124. As a result, the developing device 70 may be secured without causing a rotational displacement from the desired rotational angle position.

The value of (Za/Zb)×Zc may be set to an integer when Zc is set to an integral multiple of a value obtained by dividing the least common multiple of Za and Zb by Za.

As an example, in the present exemplary embodiment, the number of teeth Za of the rotating-body gear 110 is set to 150 (=2×3×5×5), the number of teeth Zb of the large gear 120 is set to 42 (=2×3×7), and the number of teeth Zc of the small gear 122 is set to 14 (=7×2). Here, the least common multiple of Za and Zb is 1050 (=2×3×5×5×7), and Zc is set to 14, which is obtained by multiplying 7, which is obtained by dividing the least common multiple by Za, by 2. Thus, the value of (Za/Zb)×Zc is set to an integer. Accordingly, when the developing device 70 is at the desired rotational angle position, the small gear 122 is at the position where the small gear 122 is engageable with the three projections 132 of the lock lever 124. As a result, when the developing device 70 is secured by the gear mechanism including the rotating-body gear 110, the large gear 120, and the small gear 122, the developing device 70 may be accurately secured at the desired rotational angle position without causing a rotational displacement therefrom.

Figure 5:
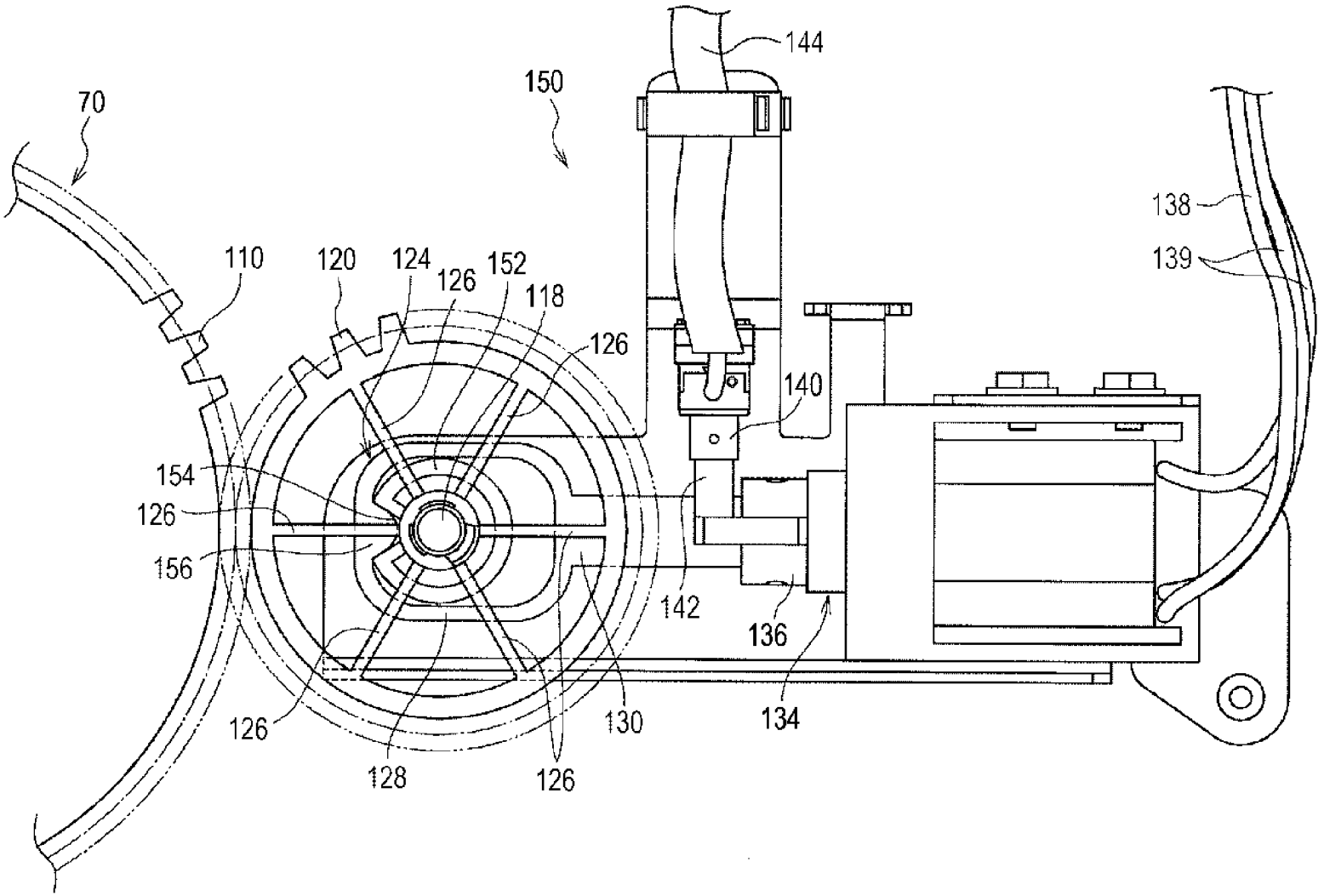
FIG. 5 is a side view similar to FIG. 3, illustrating the structure of a lock mechanism according to a comparative example to be compared with the lock device according to the exemplary embodiment.

Referring to FIG. 5, a lock mechanism 150 including a cam 152 in place of the small gear 122 will be described as a comparative example. A single recess 154 is formed in an outer peripheral surface of the cam 152, and a single projection 156 that engages with the recess 154 is formed on an inner surface of the ring-shaped portion 128 of the lock lever 124. In the lock mechanism 150, rotation of the cam 152 is restrained when the projection 156 on the lock lever 124 engages with the recess 154 in the cam 152. Accordingly, rotation of the developing device 70 is restrained by the large gear 120 and the rotating-body gear 110. Other structures are similar to those of the lock mechanism 114.

In the lock mechanism 150, only one recess 154 is formed in the cam 152. Therefore, unless the number of teeth Za of the rotating-body gear 110 is set to an integral multiple of the number of teeth Zb of the large gear 120, the recess 154 in the cam 152 cannot be placed at the position where the recess 154 is engageable with the projection 156 even when the developing device 70 is to be secured at the desired rotational angle position. As a result, the cam 152 cannot be secured. Therefore, in order for the developing device 70 to be securable at the desired rotational angle position by using the lock mechanism 150, there is a limit that the number of teeth Za of the rotating-body gear 110 is to be set to an integral multiple of the number of teeth Zb of the large gear 120.

In contrast, when the developing device 70 is secured to the desired rotational angle position by using the lock mechanism 114, the small gear 122 may be placed at the position where the small gear 122 is engageable with the projections 132 on the lock lever 124 as long as the number of teeth Zc of the small gear 122 is set to an integral multiple of a value obtained by dividing the least common multiple of the number of teeth Za of the rotating-body gear 110 and the number of teeth Zb of the large gear 120 by the number of teeth Za of the rotating-body gear 110. In other words, when the lock mechanism 114 is used, the developing device 70 may be secured at the desired rotational angle position even when the number of teeth Za of the rotating-body gear 110 is not equal to an integral multiple of the number of teeth Zb of the large gear 120.

Thus, in the lock mechanism 114, the limit to the numbers of teeth of the rotating-body gear 110 and the large gear 120 is reduced and the design versatility of the rotating-body gear 110 and the large gear 120 may be increased compared to the case in which the lock mechanism 150 is used. As a result, requirements of reduction in the developer density unevenness caused by variation in rotation of the developing device 70 and abrasion of the rotating-body gear 110 may be relatively easily satisfied by appropriately setting the specifications of the rotational-body gear 110 and the large gear 120.

As an example, in the present exemplary embodiment, the specifications of the rotating-body gear 110 are set as follows. That is, the number of teeth is set to Za=150, the module is set to m=1, the pressure angle is set to $\alpha=20°$, the helix angle is set to $\beta=17.5°$/left, and the reference diameter is set to $d=Za\times m/\cos\beta=\phi157.279$. In addition, the specifications of the large gear 120 are set as follows. That is, the number of teeth is set to Zb=42, the module is set to m=1, the pressure angle is set to $\alpha=20°$, the helix angle is set to $\beta=17.5°$/right, and the reference diameter is set to $d=Zb\times m/\cos\beta=\phi44.038$.

As described above, the small gear 122 is provided on the rotational shaft 118 of the large gear 120 that meshes with the rotating-body gear 110 that rotates together with the developing device 70. The small gear 122 is restrained from rotating when the lock lever 124 is moved to a position where the lock lever 124 meshes with the small gear 122. Accordingly, the developing device 70 is secured (restrained) at the desired rotational angle position by the large gear 120 and the rotating-body gear 110. The number of teeth Zc of the small gear 122 is set to an integral multiple of a value obtained by dividing the least common multiple of the number of teeth Za of the rotating-body gear 110 and the number of teeth Zb of the large gear 120 by the number of teeth Za of the rotating-body gear 110. Thus, even though the developing device 70 is secured at the desired rotational angle position by using the gear mechanism, the design versatility of the gear mechanism may be increased.

The rotating-body gear 110 is connected to and rotated by the electric motor 112 for rotating the developing device 70, and the rotation of the developing device 70 is restrained by engaging the large gear 120 of the lock mechanism 114 with the rotating-body gear 110. In other words, the rotating-body gear 110 provides an additional function of restraining the rotation of the developing device 70. Accordingly, the rotation of the developing device 70 may be restrained by using a simple structure.

Since multiple (three) projections 132 are provided on the inner surface of the ring-shaped portion 128 of the lock lever 124 and the small gear 122 is secured by the multiple projections 132, the securing strength is increased.

In the present exemplary embodiment, a single rotational angle position of the developing device 70 at which the black (K) developing unit 72K is at the developing position 116 is described as the desired rotational angle position where the developing device 70 is to be secured. However, the developing device 70 may also be restrained by the lock mechanism 114 while the developing units 72 for other colors are at the developing position 116. In such a case, that is, when the developing device 70 is to be securable at six rotational angle positions thereof with constant angular intervals therebetween, the number of teeth Zc of the small gear 122 may be set on the basis of one-sixth the number of teeth Za of the rotating-body gear 110. More specifically, Zc may be set to an integral multiple of a value obtained by dividing the least common multiple of Za/6 and Zb by Za/6. In other words, the number of teeth Zc of the small gear 122 may be set by setting Za to the number of teeth provided between the desired rotational angle positions to be set on the rotating-body gear 110.

In the present exemplary embodiment, the small gear 122 is an outer gear, and is secured by the projections (internal teeth) 132 formed on the inner surface of the ring-shaped portion 128 of the lock lever 124. However, the small gear 122 may instead be formed as an inner gear, and the projections 132 for securing the small gear 122 may be provided at an end portion of the shaft portion 130 of the lock lever 124.

In the present exemplary embodiment, the case in which the image forming process is performed using the six colors, which are Y, M, C, K, E, and F, is described. However, the image forming process may be performed using four colors, which are Y, M, C, and K, or five colors, which are Y, M, C, K, and one of the first and second specific colors E and F.

In addition, in the present exemplary embodiment, the developing device 70 includes six developing units for the respective colors arranged with constant intervals of 60°. Alternatively, however, the developing device may include four developing units for the respective colors arranged with constant intervals of 90°.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A rotating-body restraining device comprising:

a first gear provided on a rotational shaft of a rotating body and rotated together with the rotating body, the number of teeth included in the first gear being Za;

a second gear that meshes with the first gear, the number of teeth included in the second gear being Zb, which is not equal to the product of Za and an integer n;

a third gear provided on a rotational shaft of the second gear and rotated together with the second gear, the number of teeth included in the third gear being Zc, which is an integral multiple of a value obtained by dividing the least common multiple of Za and Zb by Za; and a restraining member that is movable toward the third gear and that restrains the third gear from rotating by moving to a position where the restraining member meshes with the third gear, wherein the third gear has a plurality of teeth formed at a constant pitch interval around a periphery thereof.

2. The rotating-body restraining device according to claim 1, wherein the first gear is connected to and rotated by a driving unit that rotates the rotating body.

3. The rotating-body restraining device according to claim 2, wherein a driving force of the driving unit is transmitted to the rotating body through the first gear, and the rotating body is rotated accordingly.

4. An image forming apparatus comprising: a plurality of developing units provided on a rotating body and containing developer used to form an image; and a rotating-body restraining device restraining the rotating body from rotating while a specific one of the developing units is at a developing position, the rotating-body restraining device comprising: a first gear provided on a rotational shaft of a rotating body and rotated together with the rotating body, the number of teeth included in the first gear being Za; a second gear that meshes with the first gear, the number of teeth included in the second gear being Zb, which is not equal to the product of Za and an integer n; a third gear provided on a rotational shaft of the second gear and rotated together with the second gear, the number of teeth included in the third gear being Zc, which is an integral multiple of a value obtained by dividing the least common multiple of Za and Zb by Za; and a restraining member that is movable toward the third gear and that restrains the third gear from rotating by moving to a position where the restraining member meshes with the third gear, wherein the third gear has a plurality of teeth formed at a constant pitch interval around a periphery thereof.

5. An image forming apparatus comprising: a plurality of developing units provided on a rotating body and filled with developer used to form an image; and a rotating-body restraining device restraining the rotating body from rotating while a specific one of the developing units is at a developing position, the rotating-body restraining device comprising: a first gear provided on a rotational shaft of a rotating body and rotated together with the rotating body, the number of teeth included in the first gear being Za; a second gear that meshes with the first gear, the number of teeth included in the second gear being Zb, which is not equal to the product of Za and an integer n; a third gear provided on a rotational shaft of the second gear and rotated together with the second gear, the number of teeth included in the third gear being Zc, which is an integral multiple of a value obtained by dividing the least common multiple of Za and Zb by Za; and a restraining member that is movable toward the third gear and that restrains the third gear from rotating by moving to a position where the restraining member meshes with the third gear, wherein the third gear has a plurality of teeth formed at a constant pitch interval around a periphery thereof, wherein the first gear is connected to and rotated by a driving unit that rotates the rotating body.

6. The image forming apparatus according to claim 4, wherein the plurality of developing units includes at least four developing units that are a yellow toner image developing unit, a magenta toner image developing unit, a cyan toner image developing unit, and a black toner image developing unit.

7. The image forming apparatus according to claim 6, wherein the plurality of developing units is six developing units that include the four developing units, a first specific color image developing unit, and a second specific color image developing unit.

8. The image forming apparatus according to claim 4, wherein the restraining member includes a mesh portion, the mesh portion having a projection that is shaped to be capable of meshing with the third gear, and the rotating body, the first gear, and the second gear are also restrained from rotating when the mesh portion meshes with the third gear.

9. The image forming apparatus according to claim 5, wherein the plurality of developing units includes at least four developing units that are a yellow toner image developing unit, a magenta toner image developing unit, a cyan toner image developing unit, and a black toner image developing unit.

10. The image forming apparatus according to claim 9, wherein the plurality of developing units is six developing units that include the four developing units, a first specific color image developing unit, and a second specific color image developing unit.

11. The image forming apparatus according to claim 5, wherein the restraining member includes a mesh portion, the mesh portion having a projection that is shaped to be capable of meshing with the third gear, and the rotating body, the first gear, and the second gear are also restrained from rotating when the mesh portion meshes with the third gear.

* * * * *